US008557314B2

(12) United States Patent
Gerbaulet et al.

(10) Patent No.: US 8,557,314 B2
(45) Date of Patent: Oct. 15, 2013

(54) CAPSULE AND METHOD FOR PREPARING A BEVERAGE SUCH AS COFFEE FROM SAID CAPSULE

(75) Inventors: Arnaud Gerbaulet, Oye et Pallet (FR); Alexandre Kollep, Lutry (CH)

(73) Assignee: Nestec S.A., Vevey (CH)

( * ) Notice: Subject to any disclaimer, the term of this patent is extended or adjusted under 35 U.S.C. 154(b) by 203 days.

(21) Appl. No.: 13/144,435

(22) PCT Filed: Nov. 12, 2010

(86) PCT No.: PCT/EP2010/067383

§ 371 (c)(1),
(2), (4) Date: Jul. 13, 2011

(87) PCT Pub. No.: WO2011/061126

PCT Pub. Date: May 26, 2011

(65) Prior Publication Data

US 2011/0274794 A1 Nov. 10, 2011

(30) Foreign Application Priority Data

Nov. 19, 2009 (EP) ..... 09176448
Dec. 18, 2009 (EP) ..... 09179813

(51) Int. Cl.
*B65B 29/02* (2006.01)

(52) U.S. Cl.
USPC ..... 426/77; 426/431; 99/295; 99/302 R

(58) Field of Classification Search
USPC ..... 426/77, 79, 78, 80, 81, 82, 83, 84; 99/295, 302 R
See application file for complete search history.

(56) References Cited

U.S. PATENT DOCUMENTS

| | | | |
|---|---|---|---|
| 4,073,949 | A | 2/1978 | Go |
| 4,913,307 | A | 4/1990 | Takata et al. |
| 7,279,188 | B2 | 10/2007 | Arrick et al. |
| 8,425,963 | B2 | 4/2013 | Ryser et al. |
| 2001/0052294 | A1 | 12/2001 | Schmed |
| 2002/0023543 | A1 | 2/2002 | Schmed |
| 2004/0228955 | A1 | 11/2004 | Denisart et al. |
| 2009/0004335 | A1 | 1/2009 | MacMahon et al. |

(Continued)

FOREIGN PATENT DOCUMENTS

| | | |
|---|---|---|
| EP | 468570 | 1/1992 |
| EP | 0554469 | 1/1992 |

(Continued)

OTHER PUBLICATIONS

Search Report for International Application No. PCT/EP2010/067383 mailed May 19, 2011.

(Continued)

*Primary Examiner* — Rena Dye
*Assistant Examiner* — Chaim Smith
(74) *Attorney, Agent, or Firm* — K&L Gates LLP

(57) ABSTRACT

Capsule for the preparation of a beverage in beverage preparation device comprising: a cup-shaped body (12) comprising a cavity containing a beverage ingredient and a flange-like rim extending outwardly from the base of said body, a delivery wall (13) connected to the flange-like rim, characterized in that the flange-like rim is formed of is a polymer material chosen in grade having a Vicat softening point (ISO 10350) between about 30 and 100° C., preferably between 40 and 90° C. or apolymer chosen in grade comprising a glass transition temperature (Tg) between 30 and 80° C., preferably between 40 and 60° C.

15 Claims, 5 Drawing Sheets

(56) References Cited

U.S. PATENT DOCUMENTS

| | | | |
|---|---|---|---|
| 2010/0034929 | A1 | 2/2010 | Dogan et al. |
| 2010/0107888 | A1 | 5/2010 | Kollep et al. |
| 2010/0173053 | A1 | 7/2010 | Ryser et al. |
| 2010/0288132 | A1 | 11/2010 | Gavillet et al. |
| 2011/0033580 | A1 | 2/2011 | Biesheuvel et al. |
| 2011/0045144 | A1 | 2/2011 | Boussemart et al. |
| 2012/0180670 | A1 | 7/2012 | Yoakim et al. |

FOREIGN PATENT DOCUMENTS

| | | |
|---|---|---|
| EP | 0524464 | 7/1992 |
| EP | 1440639 | 7/2004 |
| EP | 1654966 | 5/2006 |
| EP | 1700548 | 9/2006 |
| EP | 1702543 | 9/2006 |
| EP | 1816936 | 8/2008 |
| EP | 1975087 | 10/2008 |
| FR | 2617389 | 1/1989 |
| WO | 9317932 | 9/1993 |
| WO | 03073896 | 9/2003 |
| WO | 2006030461 | 3/2006 |
| WO | 2007122208 | 11/2007 |
| WO | 2007137974 | 12/2007 |
| WO | WO 2008037642 | 4/2008 |
| WO | 2009050540 | 4/2009 |
| WO | 2009053811 | 4/2009 |
| WO | 2009090380 | 7/2009 |
| WO | WO 2009115474 | 9/2009 |
| WO | 2009128016 | 10/2009 |
| WO | 2010041179 | 4/2010 |
| WO | 2010084475 | 7/2010 |
| WO | 2010116284 | 10/2010 |

OTHER PUBLICATIONS

D. Tripathi, "Practical Guide to Polypropylene," Rapra Practical Guide Series, 2002, 3 pages.

C. Vasile, et al., "Practical Guide to Polypropylene," Rapra Practical Guide Series, 2005, 4 pages.

Eriks, Solutions in Plastics, PET Datasheet, 3 pages.

E. Abdel-Bary, "Handbook of Plastic Films," Rapra Technology Ltd., 2003, pages.

Chemical of the Week: Polymers (taken from http://scifun.chem.wisc.edu), 1 page.

Polymer processing: Which poly(ethylene terephthalate), PET resin is the best one?, (taken from http://polymerprocessing.blogspot.n1/2009/03/which-polyethylene-terephthalate-pet.html, 1 page.

NAPCOR (National Association for PET Container Resources), "What is PET?" (taken from http://www.napcor.com/PET/whatisapet.html) 1 page.

J. Menczel et al., "Thermal Analysis of Polymers, Fundamentals and Applications", 2009, 3 pages.

NEN-EN-ISO 10350-2, Plastics—Acquisition and presentation of comparable single-point data—Part 2: Long fibre-reinforced plastics (ISO 10350-2:2011, IDT), European Standard, Mar. 2011, 24 pages.

NEN-EN-ISO 306, European Standard (draft), Plastics—Thermoplastic materials—Determination of Vicat softening temperature (VST) (ISO/DIS 306:2012), Jan. 2012, 29 pages.

R. Auras, "Polylactic Acid as a new Biodegradable Commodity Polymer", 41 pages.

Excerpts from website www.makeitfrom.com (PE, EVA), May 2013, 5 pages.

CAPSULE AND METHOD FOR PREPARING A BEVERAGE SUCH AS COFFEE FROM SAID CAPSULE

FIELD OF THE INVENTION

The present invention relates to a capsule and a method for preparing a beverage such as a coffee extract from a single-use capsule containing a beverage ingredient (e.g., roast and ground coffee) inserted in a beverage producing beverage.

BACKGROUND INFORMATION

A successful method for preparing a beverage from capsules containing a beverage ingredient is described in EPO468570. The principles consists in inserting a capsule containing coffee powder and extracting a coffee liquid by tearing a delivery membrane of the capsule under the effect of pressure against a capsule holder comprising a network of small truncated pyramids. The truncated pyramids create controlled orifices in the membrane and filter the coffee extract that is discharged through the capsule holder then down to a discharge duct.

Other patent publications relate to providing a sealing member at the capsule for improving liquid tightness between the capsule and the pressurized water injection system such as EP1654966, EP1702543, EP1700548, EP1816936 and WO 2009/115474.

Certain consumers prefer coffees that have not too strong taste or aroma characteristics that are typically obtainable by the high pressure extraction method of the prior art. For certain coffees like lungo, the method may also produce over-extraction of compounds that provide undesired bitterness to the coffee extract.

Therefore, it would be advantageous to deliver a coffee beverage of lighter strength or taste, or less dense coffee crema, while maintaining the effectiveness of the prior art extraction principle which can deliver on demand coffee beverages which are intimately extracted with a high aroma intensity and thick crema.

SUMMARY OF THE INVENTION

One object of the present invention is to provide a solution to this need by proposing a method which principle is to create a water bypass to dilute the coffee extract which is extracted through the capsule with hot water from the device.

More particularly, the invention relates to a method for the preparation of a beverage, preferably coffee, using a capsule containing a dose of beverage ingredient, preferably ground coffee, by insertion of the capsule in a beverage preparation unit comprising a capsule holder and a water injection enclosing member; comprising the operations of:

- inserting the capsule between the capsule holder and the water injection enclosing member while pressing the sealing rim against the capsule holder by a grooved pressing surface of the water injection enclosing member,
- injecting water under pressure in the volume between the capsule and water injection enclosing member and in the capsule,
- wherein a bypass of water is provided at the beginning of the water injection operation between the pressing surface comprising radial grooves and the capsule,
- wherein such water bypass is stopped or at least reduced when further carrying on the water injection step,

- wherein liquid extract is forced to flow from the interior of the capsule through the delivery wall, through the capsule holder and to a discharge duct and,
- wherein the water bypass is collected and also guided to said discharge duct.

In the preferred mode, the water bypass is stopped or at least reduced during water injection by softening the material of the rim under the effect of hot liquid injected between the capsule and the enclosing member and the mechanical pressure exerted by the injection enclosing member on the rim.

In a first mode, the material of the rim is preferably a semicrystalline polymer material chosen in a grade having a Vicat softening point (ISO 10350) between about 30 and 100° C., preferably between 40 and 90° C., most preferably between 40° C. and 80° C.

Preferably, the semicrystalline material comprises thermoplastic polymer of the group of polyolefins.

More preferably, the material is selected amongst the group of:

- polyethylene in particular high density polyethylene, medium density polyethylene, low linear density polyethylene,
- a blend of:
  - a) a polymer chosen amongst polyethylene (PE) or polypropylene (PP) and,
  - b) at least one copolymer chosen amongst the group consisting of: ethylene copolymer(s) or terpolymer(s) of ethylene and combinations thereof.

Most preferably, said copolymer of the list b) is chosen amongst the group consisting of:

- b1) EVA (ethylene vinyl acetate), EMA (ethylene glycol monobutyl monomer ether acetate), EBA (poly(ethylene-co-butyl acrylate) and combinations thereof, or
- b2) a polyolefin elastomer or plastomer, preferably EPDM (ethylene propylene diene monomer),
- or combinations thereof.

In particular, said polymer a (i.e., PE or PP) provides the mechanical properties to the capsule, in particular, its resistance against buckling during perforation by the injection needles. It also compensates for the lower heat resistance of the second polymer or functional polyolefins (i.e., EVA, EMA EBA, etc.).

Instead of or in addition to low heat resistant polyolefins, a rubber elastomer (TPEs) or plastomer can be added to the first polymer to provide similar functions.

Therefore, preferably, the ratio of polymer(s) and copolymer(s) a:b, is comprised between 10:0.1 and 10:5, more preferably 10:0.2 to 10:3, most preferably 10:0.3 to 10:1.

Additional charges and/or specific additives can also be added into the material such as in copolymer(s) of the list b, such as calcium carbonate, titanium dioxide, fibres, glass beads and combinations thereof.

In another mode, the material constituting at least part of the rim is an (e.g., thermoplastic) polymer chosen in a grade having a glass transition temperature (Tg) between 30 and 80° C., preferably between 40 and 60° C. When the glass transition temperature of the material has been reached, because of the hot injected liquid, the material behaves like rubber. This causes the grooves of the pressing surface of the injection enclosing member to become clogged by the material and, consequently, the bypass of water to stop.

Preferably, the polymer material which constitutes at least part of the rim is a biodegradable polyester. This polyester is also preferably an agro-resource-based polyester.

Preferably, the polymer material which constitutes at least part of the rim is chosen amongst the group consisting of: polyester such as crystallized or semi-crystallized PET (cPET), crystallized or semicrystallized polylactic acid (cPLA) PET (polyethylene terephtalate), PLA (polylactic acid) and combinations thereof.

At least partially crystallized PLA or PET is preferred to non-crystallized PLA or PET since it provides a higher temperature and pressure resistance during extraction.

In one mode, the PLA polyester is a blend or copolymer of PLLA (poly-L-lactide) and PDLA (poly-D-lactide). The ratio of PLLA:PDLA can be varied depending on the degree of crystallinity, mechanical properties and temperature resistance desired.

According to the present invention, the synergy between the behaviour properties of the material of the capsule, in particular its rim, and the configuration of the device provides a certain dilution ratio of the final beverage. The dilution ratio can be controlled by choosing the proper material of the capsule and dimensioning the grooved pressing surface of the device accordingly.

The extraction is carried out in basically two steps; a first step during which a certain water bypass is provided along the rim and a second step during which the beverage is essentially extracted through the capsule and the bypass reduced or stopped. This result in a weaker, lower-crema coffee compared to typical coffee bar beverages (espresso/lungo) obtained by prior art capsule systems providing no bypass effect.

The delivery wall of the capsule preferably tears under pressure against protrusions provided on the capsule holder during water injection. In particular, the delivery wall is an aluminium membrane of thickness comprised between 10 and 120 microns, preferably between 20 and 100 microns. The membrane is allowed to tear only when a threshold of pressure is reached in the capsule according to the principle described in EPO468570. This enables to provide a higher interaction of coffee and hot water in the capsule. It also promotes the bypass of water in the first part of the extraction. However, a compromise should be reached to ensure that the bypass is not too large which would prevent pressure from increasing sufficiently in the capsule and thereby the membrane from tearing against the capsule holder. Such control can be obtained by choosing the material of the rim, as well as the thickness of the rim. For this, the rim has preferably a thickness comprised between 0.5 and 1.2 mm, most preferably 0.7 to 1.1 mm.

In an alternative, the delivery wall can be a porous wall. The advantage is a lower pressure building in the capsule and potentially weaker extraction results (i.e., lower total solids (Tc) in cup).

The present invention further relates to a capsule for the preparation of a beverage in a beverage preparation device comprising:

- a cup-shaped body comprising a cavity containing a beverage ingredient and a flange-like rim extending outwardly from the base of said body,
- a delivery wall connected to the flange-like rim,
- characterized in that the flange-like rim is formed of a polymer material chosen in a grade having a Vicat softening point (ISO 10350) between about 30 and 100° C., preferably between 40 and 90° C., most preferably between 40 and 80° C. or an polymer chosen in a grade having a glass transition temperature (Tg) between 30 and 80° C., preferably between 40 and 60° C.

Although the capsule of the invention is preferably utilized for carrying out the method of the invention, it is not limited to this method.

In a mode, the polymer material is an agro-resource based polyester.

In a mode, the polymer material is selected amongst the group consisting of: polyester such as crystallized or semicrystallized PET (cPET), crystallized or semicrystallized polylactic acid (cPLA) PET (polyethylene terephtalate), PLA (polylactic acid) and combinations thereof.

In one mode, the PLA polyester is a blend or copolymer of PLLA (i.e., poly-L-lactide) and PDLA (i.e., poly-D-lactide). The ratio of PLLA:PDLA can be varied depending on the degree of crystallinity, mechanichal properties and temperature resistance desired. The ratio of PLLA to PDLA may range of from 99:1 to 40:60, more preferably 95:5 to 50:50.

In a mode, the delivery wall is a membrane configured for being at least partially torn under pressure against protrusions provided on the capsule holder during water injection.

In a mode, the delivery wall is configured with filtering apertures. The filtering apertures preferably have a diameter of less than 300 microns, more preferably, less than 200, most preferably less than 100 microns.

The rim preferably has a thickness between 0.5 and 1.2 mm.

In a mode, the flange-like rim has a thickness which comprises at least a portion which is of greater thickness than the thickness of the sidewall of the body. This increase of thickness ensures sufficient material can be softened and pressed by the grooved pressing surface of the water injection member to provide a final liquid-tight engagement.

In a mode, the flange-like rim comprises the flange-like rim comprises at least one lip forming a local increase of thickness protruding from the rim in a direction opposite to the membrane. Again, this configuration ensures that sufficient material of the rim can be softened and pressed by the grooved pressing surface of the water injection member to provide a final liquid-tight engagement while maintaining a light, eco-friendly structure for the capsule.

In a mode, the membrane is an aluminium or aluminium alloy membrane.

In another mode, the membrane is made of the same material as the polymer material of the body.

The invention also relates to a system for the preparation of a beverage comprising a capsule as aforementioned and a beverage preparation unit wherein the unit comprises a capsule holder and an enclosing member for receiving the capsule; said enclosing member comprising an annular pressing surface comprising radial grooves; said pressing surface being configured for compressing the flange-like rim of the capsule wherein the material of the flange-like rim is configured during water injection for clogging the grooves of the pressing surface thereby providing a liquid-tight engagement between the capsule and the enclosing member.

BRIEF DESCRIPTION OF THE DRAWINGS

The invention will be better understood in relation to the figures attached which are given as a preferred embodiment.

DETAILED DESCRIPTION OF THE INVENTION

Figure 1:
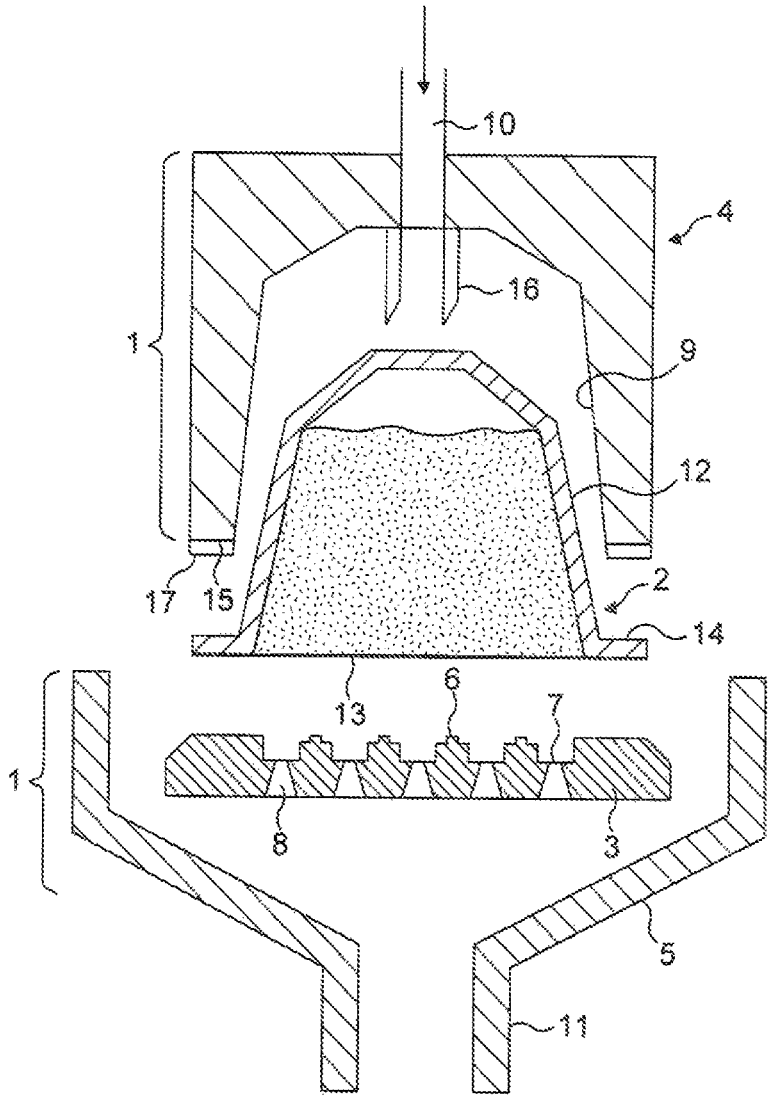
FIG. 1 shows the operation of insertion of the capsule in the beverage preparation device according to the method of the invention.

In the method of the present invention, a beverage preparation device 1 is provided into which is inserted a capsule 2. The device 1 comprises a capsule holder 3, a water injection enclosing member 4 and a collector 5.

The capsule holder 3 is formed of a support member comprising protrusions such as truncated pyramids 6, channels 7 between the protrusions and orifices 8 provided through the holder 3 for draining liquid extract through the capsule holder.

The water injection enclosing member 4 has the shape of a bell with an internal cavity 9, an injection conduit 10 and blades 16 enabling to perforate water inlets in the inlet face of the capsule 2. At the free end of the enclosing member 4 is provided a pressing surface 17 comprising a plurality of radial grooves 15 as described in WO 2009/115474 herein enclosed by reference. In the present invention, the grooves are utilized here to control a temporary bypass of water between the capsule and the enclosing member, until a liquid-tight sealing is obtained by clogging of the grooves with the material of the capsule as will be explained.

Downstream of the capsule holder is provided a collector 5 for collecting the liquid extract as well as water leaking from the device. The collector is designed to guide liquid to a common discharge liquid duct 11. Therefore, the collector is large enough to encompass the periphery of the capsule holder. For example, the collector can be designed as described in WO 2009/115474. It should be noted that the device may be oriented differently, for instance, with the enclosing member 4 and capsule holder being substantially horizontal rather than vertical (i.e., said holder 3 below said member 4) as represented here.

The capsule 2 according to the invention has a cup-shaped body 12 containing a dose beverage ingredient, e.g., roast and ground coffee, and a delivery wall 13 sealed onto the rim 14 of the body.

The delivery wall 13 can be of various configurations.

In a preferred configuration, the delivery wall is a thin membrane which tears under the pressure of extraction building up in the capsule against the protrusions 6, e.g., aluminium membrane of between 20-120 microns, as described in EPO468570. "Aluminium" also encompasses here any suitable kind of aluminium alloys. The thin membrane may comprise means for reducing the resistance of the membrane such as weakening lines or cuts or means for reducing the opening pressure of the membrane in the capsule such as a limited number of tiny pre-perforated holes.

In a second configuration, the delivery wall is formed of a porous wall that does not tear or tears only partially under the pressure against the capsule holder.

The body of the capsule is preferably formed integrally with the flange-like rim 14. The material for the rim is preferably at least partially made of or at least covered by a sealing material that softens under contact with the hot pressurized liquid. Preferably, the entire body is made integrally of this material.

As aforementioned, the material is formed of a polymer material having a Vicat softening point (ISO 10350) between about 30 and 100° C., preferably between 40 and 90° C.

As known per se, the Vicat softening temperature is the temperature at which a flat-ended needle penetrates the specimen to the depth of 1 mm under a specific load (50N).

In a first mode, the polymer material can be a thermoplastic polymer, preferably polyolefins. In the preferred mode, the polymer is polyethylene such as high density polyethylene (HDPE), medium density polyethylene (MDPE), or low linear density polyethylene (LLDPE) wherein the grade of the polyethylene material is chosen to meet the Vicat softening point within the defined range.

In a second mode the polymer material is a blend of:

a1— a polymer chosen amongst polyethylene (PE) or polypropylene (PP) and, b1— at least one second copolymer of ethylene copolymer or terpolymer of ethylene, most preferably chosen amongst EVA (Ethylene vinyl acetate), EMA (ethylene glycol monobutyl monomer ether acetate), EBA (poly (ethylene-co-butyl acrylate) and combinations thereof.

The ratio of a:b1 is preferably comprised between 10:0.1 and 10:5, more preferably 10:0.2 to 10:3, most preferably 10:0.3 to 10:1.

In a third mode, the polymer is a blend of:

a— a polymer chosen amongst polyethylene (PE) or polypropylene (PP) and b2— a rubber elastomer or plastomer.

The polymer b2 can be EPDM (ethylene propylene diene monomer) or a blend of EPDM and metalocene plastomer.

The ratio of a:b2 is preferably comprised between 10:0.1 and 10:5, more preferably 10:0.2 to 10:3, most preferably 10:0.3 to 10:1.

In another mode, the polymer material may also be chosen amongst polymer(s) chosen in a grade comprising a glass transition temperature (Tg) between 30 and 80° C., preferably between 40 and 60° C.

The polymer material can be chosen amongst agro-resources-based polyesters.

Therefore, in a fourth mode, the material is selected amongst the group consisting of: polyester such as crystallized or semi-crystallized PET (cPET), crystallized or semi-crystallized polylactic acid (cPLA) PET (polyethylene terephtalate), PLA (polylactic acid) and combinations thereof.

Poly(lactic acid) (i.e., PLA) can be produced in different ways: chemical or biological, such as by fermentation of carbohydrate from lactobaccilus. The PLA comprises different enantiomeric monomers (PLLA or PDLA) are polycondensed via its cyclic dimmer (lactide) by ring-opening polymerisation to a high molecular weight polymer. The heat properties and crystallinity of PLA is related to the ratio between the two mesoforms D and L. For the invention, the ratio of PLLA:PDLA preferably varies of from 95:5 to 40:60. The PLA may be further plasticized by oligomeric lactic acid (OLA), citrate ester, low molecular weight polyethylene-glycol (PEG) and combinations thereof.

Figure 2:
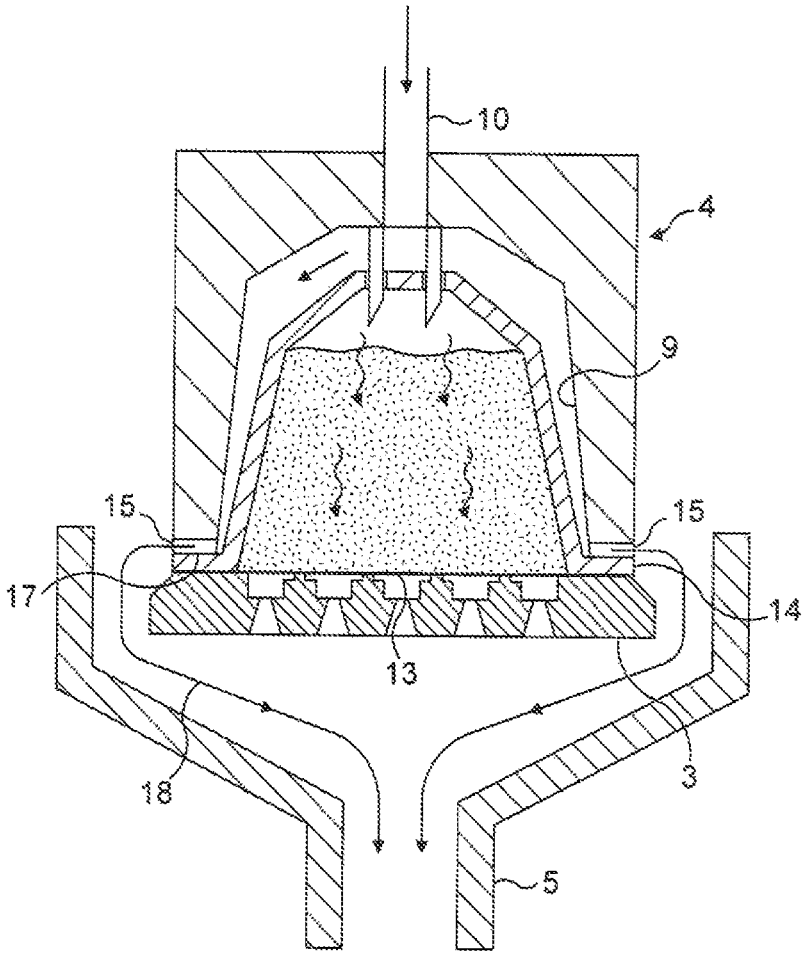
FIG. 2 shows the operation of water injection at the start of the coffee extraction in the closed device.
Figure 3:
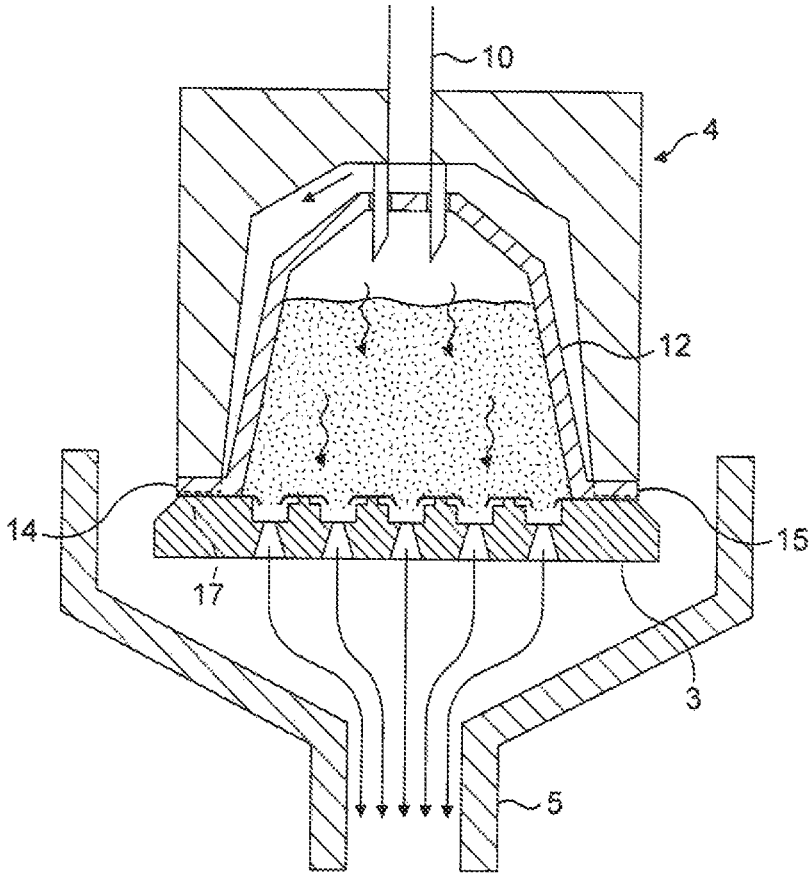
FIG. 3 shows the operation of water injection water injection during coffee extraction.

As illustrated in FIG. 2, the device is closed onto the capsule by application of a mechanical and/or hydraulic pressure of the pressing surface of the enclosing member 4 onto the rim of the capsule. A closure obtained by combination of mechanical and hydraulic means is described, for example, in WO 2008/037642 herein incorporated by reference.

The method comprises an operation of injection of hot water through the injection enclosing member 4 in the cavity after closing as shown in FIG. 2. In the early phase of this operation (FIG. 2), the material of the rim is not yet softened by the pressurized liquid. Thereby the grooves 15 remain at least partially opened forming water bypassing through-holes in the enclosing member 4. The pump of the device, e.g., a piston pump (not illustrated) forces water under pressure in the cavity. The rising pressure thereby causes water to flow through the restriction formed by the grooves which are not yet clogged by the material of the rim. This leakage provides a bypass 18 for the flow of water which is collected by the collector 5 and drains through the discharge duct 11 to fill the receptacle (e.g., the coffee cup) placed underneath. During this phase, the pressure loss created in the capsule (e.g., by the coffee bed and delivery wall) may be higher than the pressure loss created outside the capsule, i.e., by the flow restriction caused by the grooves 15. As a result, essentially water is drained at the interface between the rim and the enclosing member. During this phase, the membrane does not perforate yet against the capsule holder 3 or perforates only partially thereby causing some liquid extract to start being dispensed from the capsule. Water or resulting mixture (i.e., water and some liquid extract) is collected by the collector 5 and into the receptacle.

In the next phase of the method of the invention, pressurized hot water has softened the rim sufficiently that the enclosing member penetrates further into the rim due to the mechanical/hydraulic pressure causing the grooves 15 to become clogged by the material of the rim. As a result, the water bypass 18 stops or is at least significantly reduced which causes the pressure in the capsule to further rise significantly. Interaction between coffee powder and water is normally obtained at a higher pressure than in the first extraction phase. When the delivery wall is a tear membrane, it can perforate against the protrusions (or be further torn)) and the liquid extract is released, as illustrated, at least a higher flow rate than in the first phase.

When the delivery wall is a porous member, the liquid extract overcomes the back-pressure of the wall and discharges through the capsule holder.

Figure 4:
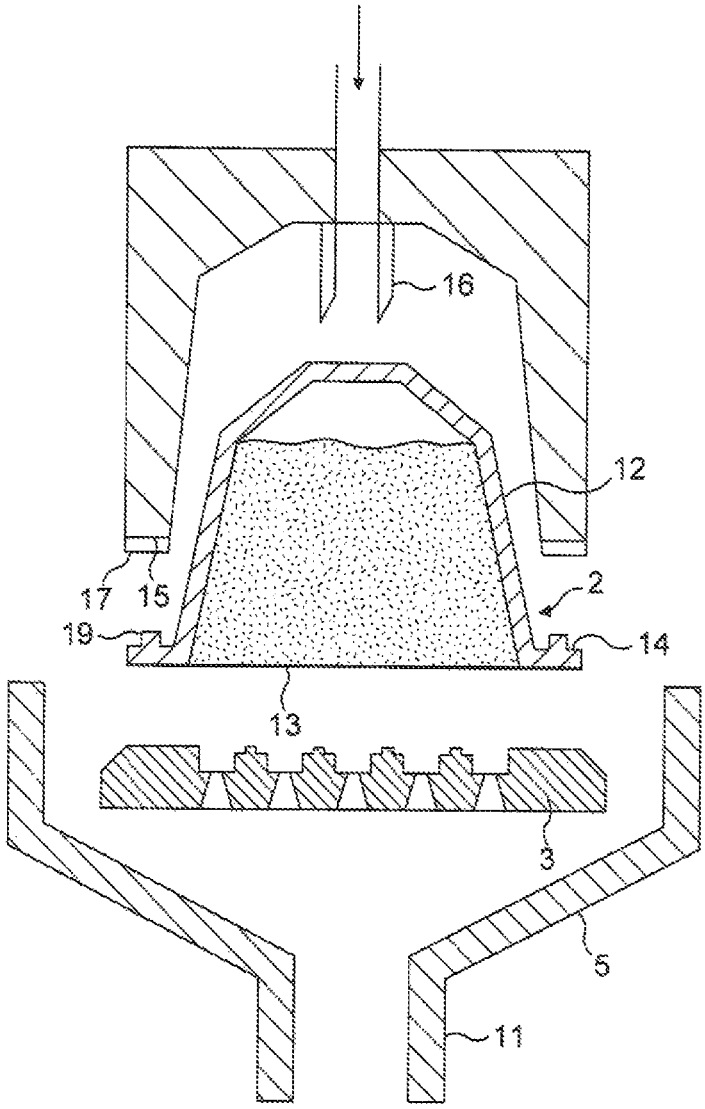
FIG. 4 shows the operation of insertion of the capsule in the beverage preparation device according to a second embodiment of the capsule.

FIG. 4 illustrates a variant of the invention in which the capsule 2 comprises a flange-like rim 14 which comprises a lip 19 forming a local increase of thickness protruding in a direction opposite to the delivery wall 13. The lip is configured on the flange-like rim to be deformed by the pressing surface 17 of the enclosing member 4 to fill the grooves 15 after sufficient softening by hot water under pressure pressing outwardly at the external surface of the body. One or more than one lip can extend from the base portion of the rim, such as a series of two or three concentric annular lips.

The lip can be made so that it is more flexible and/or thinner than the transversal annular wall of the rim. As a result, the lip softens more rapidly while the rest of the rim becomes remains rigid.

The lip preferably comprises a cross section that decreases from its base to its free end, e.g., forming a conical, pyramidal or rounded section.

Figure 5:
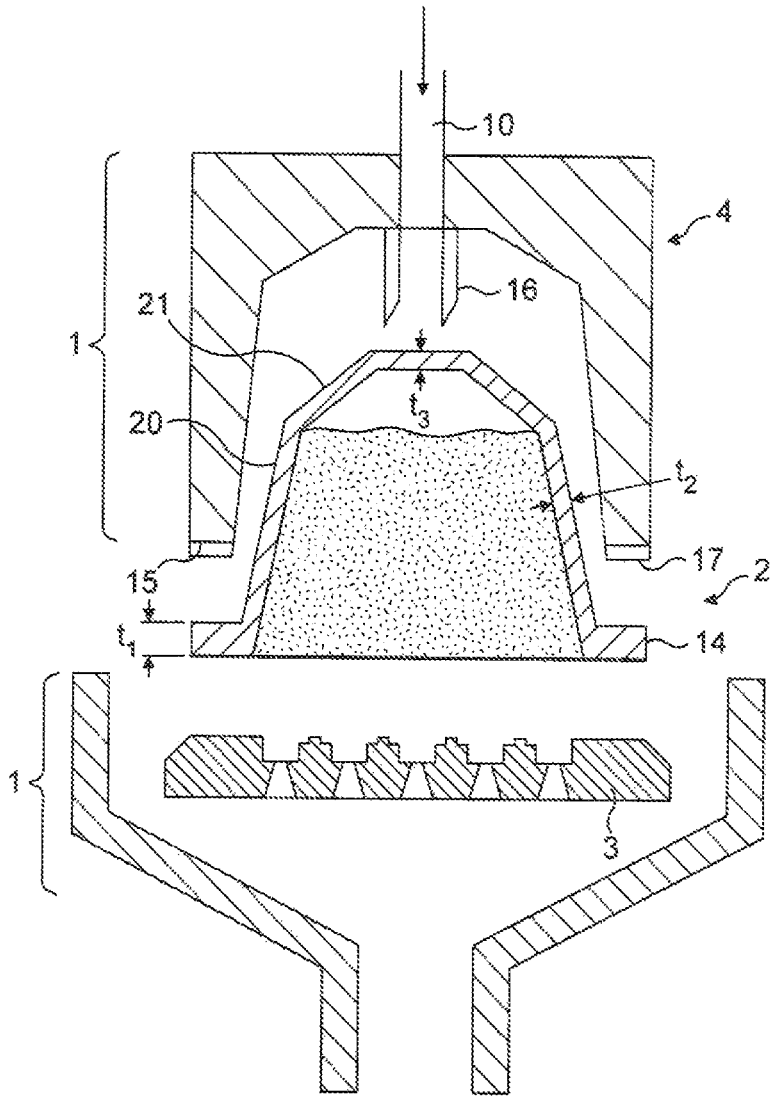
FIG. 5 shows the operation of insertion of the capsule in the beverage preparation device according to a third embodiment of the capsule.

FIG. 5 illustrates another variant in which the capsule 2 comprises a flange-like rim 14 which is thicker than at least a wall portion of the body 12 outside the rim. In particular, the body comprises three portions, a flange-like rim 14, a sidewall 20 and a bottom wall 21. The thickness (t1) of the flange-like rim 14 is dimensioned to be thicker than the thickness (t2) of the sidewall 20 or than the thickness (t3) of the bottom wall 21. Preferably, the thickness (t2) of the sidewall 20 is equal or higher than the thickness (t3) of the bottom wall. The bottom wall 21 is preferably made thinner to provide a lesser resistance to perforation by the perforating elements 16 whereas the flange-like rim is made thicker to ensure a sufficient amount of material for sealing purpose. Of course, the flange-like rim 14 could also be made as thick as the sidewall 20 and only the bottom wall is made thinner. Also, the flange-like rim could also be as in the embodiment of FIG. 4, i.e., with a lip protruding from the base portion of the rim.

In a possible mode, the sealing means (e.g. lip 19 or increase thickness) provides a liguid-tight engagement with the pressing surface which is effective from the beginning of the water injection operation without creating a bypass as aforementioned. In particular, a tight-engagement can be desired to ensure higher pressure conditions in the capsule, for example, when extracting a short and/or stronger coffee such as espresso or ristretto types

The invention claimed is:

1. Capsule for the preparation of a beverage in a beverage preparation device comprising:

a cup-shaped body comprising a cavity containing a beverage ingredient and a flange-like rim extending outwardly from the base of the body, a delivery wall connected to the flange-like rim, the flange-like rim is formed of a polymer material having a characteristic selected from the group consisting of a Vicat softening point (ISO 10350) between about 30 and 100° C., and a glass transition temperature (Tg) between 30 and 80° C.

2. Capsule according to claim 1, wherein the polymer material is selected from the group consisting of:

polyethylene, a blend of: a polymer selected from the group consisting of polyethylene (PE) and polypropylene (PP); and at least one polymer selected from the group consisting of: ethylene copolymer(s) and terpolymer(s) and combinations thereof.

3. Capsule according to claim 2, wherein the copolymer(s) is selected from the group consisting of:

EVA (Ethylene vinyl acetate), EMA (ethylene glycol monobutyl monomer ether acetate), EBA (poly(ethylene-co-butyl acrylate) and combinations thereof, or a rubber elastomer or plastomer, preferably EPDM (ethylene propylene diene monomer)

and combinations thereof.

4. Capsule according to claim 1, wherein the polymer material is an agro-resource based polyester.

5. Capsule according to claim 1, wherein the polymer material is selected from the group consisting of: crystallized or semi-crystallized PET (cPET), crystallized or semicrystallized polylactic acid (cPLA) PET (polyethylene terephtalate), PLA (polylactic acid) and combinations thereof

6. Capsule according to claim 1, wherein the delivery wall is a membrane designed to be at least partially torn under pressure against protrusions provided on the capsule holder during water injection.

7. Capsule according to claim 1, wherein the delivery wall has filtering apertures.

8. Capsule according to claim 7, wherein the filtering apertures have a diameter of less than 300 microns.

9. Capsule according to claim 1, wherein the flange-like rim has a thickness which comprises at least a portion which is of greater thickness than a thickness of at least one of the other walls of the body.

10. Capsule according to claim 1, wherein the flange-like rim comprises at least one lip forming a local increase of thickness protruding from the rim in a direction opposite to the membrane.

11. Capsule according to claim 1, wherein the membrane is an aluminium or aluminium alloy membrane.

12. Capsule according to claim 1, wherein the membrane is made of the same material as the polymer material of the body.

13. Capsule according to claim 1, wherein the rim has a thickness of between 0.5 and 1.2 mm.

14. A system for the preparation of a beverage comprising:

a capsule comprising a cup-shaped body comprising a cavity containing a beverage ingredient and a flange-like rim extending outwardly from the base of the body, a delivery wall connected to the flange-like rim, the flange-like rim is formed of a polymer material having a characteristic selected from the group consisting of a Vicat softening point (ISO 10350) between about 30 and 100° C., and a glass transition temperature (Tg) between 30 and 80° C.; and a beverage preparation unit, the unit comprises a capsule holder and an enclosing member for receiving the capsule, the enclosing member comprising an annular pressing surface comprising radial grooves, the pressing surface being designed to compress the flange-like rim of the capsule the material of the flange-like rim is designed during water injection for clogging the grooves of the pressing surface thereby providing a liquid-tight engagement between the capsule and the enclosing member.

15. Method for the preparation of a beverage, using the capsule of claim 1 containing a dose of beverage ingredient, by insertion of a capsule in a beverage preparation unit comprising a capsule holder and a water injection enclosing member; comprising the steps of:

inserting the capsule between the capsule holder and the water injection enclosing member while pressing the sealing rim against the capsule holder by a grooved pressing surface of the water injection enclosing member;

injecting water under pressure in a volume between the capsule and water injection enclosing member and in the capsule;

providing a bypass of water at the beginning of the water injection operation between a pressing surface comprising radial grooves and the capsule, the water bypass is stopped or reduced as further water is injected;

forcing a liquid extract to flow from the interior of the capsule through the delivery wall, apertures of the capsule holder and to a discharge duct; and the water bypass is collected and discharged through the discharge duct.

* * * * *